US006392519B1

(12) United States Patent
Ronning

(10) Patent No.: US 6,392,519 B1
(45) Date of Patent: May 21, 2002

(54) MAGNETIC CORE MOUNTING SYSTEM

(75) Inventor: Jeffrey J. Ronning, Fishers, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/706,488

(22) Filed: Nov. 3, 2000

(51) Int. Cl.[7] ..... H01F 27/02

(52) U.S. Cl. ..... 336/90; 336/61; 336/65; 336/96

(58) Field of Search ..... 336/61, 65, 59, 336/90, 96, 92

(56) References Cited

U.S. PATENT DOCUMENTS

| | | | | | |
|---|---|---|---|---|---|
| 4,029,926 | A | * | 6/1977 | Austin | 219/10.49 |
| 4,111,339 | A | | 9/1978 | Schmidt | 222/396 |
| 4,945,255 | A | * | 7/1990 | Suzuki et al. | 307/17 |
| 5,210,513 | A | | 5/1993 | Khan et al. | 336/61 |
| 6,177,855 | B1 | * | 1/2001 | Bouillot et al. | 336/178 |

OTHER PUBLICATIONS

Young, "Thermal Gap Fillers:New Material Overcomes Performance Trade–Offs," Chomerics, Marlow, Buckinghamshire, UK, Thermal Management—No date.

Therm–a–Gap™ A574 Material, Chomerics Parker Hannifin Corp., 1997. No month.

Therm–a–Gap™ T274 and A274 Materials, Chomerics. No month.

Therm–a–Gap™ F574, Ultra–Conformable, Highly Thermally Conductive Elastomer. No date.

Therm–a–Gap™ Interface Materials Highly Conformable, Thermally Conductive Gap Fillers, Cho–Therm® Thermal Interface Materials, Chomericas, Technical Bulletin 70. No date.

V–Therm™ Highly Thermally Conductive Elastomer, Chomerics, Technical Bulletin, Rev.2–998. No date.

* cited by examiner

*Primary Examiner*—Lincoln Donovan
*Assistant Examiner*—Minh D. Nguyen
(74) *Attorney, Agent, or Firm*—Margaret A. Dobrowitsky

(57) ABSTRACT

A mounting apparatus for an electromagnetic device such as a transformer of inductor includes a generally planar metallic plate as a first heat sink, and a metallic mounting cup as a second heat sink. The mounting cup includes a cavity configured to receive the electromagnetic device, the cavity being defined by a base, and an axially-extending annular sidewall extending from the base to a flange portion of the mounting cup. The mounting cup includes first and second passages for allowing the leads of first and second windings of the electromagnetic device to be routed out of the cavity. The cavity is filled with a polyurethane potting resin, and the mounting cup, including the potted electromagnetic device, is mounted to the plate heat sink using fasteners. The mounting cup, which surrounds the electromagnetic device, in combination with the potting resin provides improved thermal transfer to the plate heat sink, as well as providing resistance to vibration and shocks.

16 Claims, 2 Drawing Sheets

MAGNETIC CORE MOUNTING SYSTEM

This invention was made with U.S. Government support through Definitized Subcontract C-HEV-5A under MRI/CHRYSLER LETTER SUBCONTRACT NO. ZAN-6-16334-01, which subcontract was in turn issued uder MRI/CHRYSLER PRIME CONTRACT NO. DE-AC36-83CH10093 awarded by the Department of Energy, and, in accordance with the terms set forth in said contracts, the U.S. Government may have certain rights in the invention.

BACKGROUND OF THE INVENTION

1. Technical Field

This invention relates generally to a mounting system for an electromagnetic apparatus such as an inductor or transformer, and, more particularly, to such a mounting system which further includes a cooling function.

2. Description of the Related Art

The use of an electromagnetic apparatus, such as a transformer or an inductor, in electronic assemblies is common in the automotive industry. The electromagnetic apparatus generally includes a magnetic core and a winding disposed on the core (i.e., one for an inductor, or two windings for a transformer). High-frequency operation of the apparatus generates heat, both within the winding and in the magnetic core itself. As the operating frequency increases, so too does the heat component in the core. To avoid reduced performance, and/or damage, the heat generated in the core must be removed. Heat removal may occur either through transfer from the core surface by convection to the surrounding air or by direct thermal contact with an adjacent solid material (i.e., a heat sink). As to the former mode, it is often undesirable to heat the surrounding air, as this can make the surrounding air too hot for neighboring electrical components. Accordingly, the latter mode of heat transfer (i.e., direct thermal conduction) is often used to remove heat from the core/windings to avoid increasing the surrounding air temperature.

As further background, the heat generated in the windings is generally of higher concern than that in the core material. This is because effective heat transfer across multiple turns of insulated wire is difficult to achieve while maintaining moderate temperature gradients in the wires. That is, layers of electrical insulation and air gaps associated with the turns of wire make conduction of heat across the winding very inefficient. For this reason, it is known to apply potting material to encapsulate the winding to eliminate air gaps and thereby increase the effective thermal conductivity. Heat generated in the winding must also be removed, and is either transferred into the core material, or, into the surrounding air by way of convection. As mentioned above, however, heating of the surrounding air is generally undesirable inasmuch as it increases the surrounding air temperature, perhaps to elevated levels detrimental to surrounding electrical components. Accordingly, in view of e forgoing, there has been much investigation into systems for cooling both magnetic cores and windings.

One approach taken in the art to address some of the foregoing problems involves sandwiching a magnetic core between two sheets of thermally conductive material such as metal, as seen by reference to U.S. Pat. No. 5,210,513 issued to Khan et al., hereby incorporated by reference in its entirety. Khan et al. disclose an electromagnetic apparatus including a magnetic core having at least one winding disposed on a central leg of the core. Khan et al. further disclose a first, generally planar heat sink on one side of the magnetic core, and a second heat sink, also generally planar in shape, on an opposing side of the core. Both heat sinks are attached so as to engage the magnetic core in a sandwich arrangement. However, Khan et al. does not address the problem described above dealing with the removal of heat generated in the windings, and, appears to allow much of the generated heat to be transferred to the surrounding air, which is generally undesirable. Additionally, Khan et al. does not appear to protect against damage to the delicate windings/core material due to vibration or structural shock, particularly shock in the plane of the sandwiching metal sheets. The automotive environment, for example, is characterized by high vibration and/or repeated shock. These factors also require due consideration when evaluating mechanisms for mounting an electromagnetic apparatus destined for such relatively harsh environments. Finally, the system of Khan et al. may not be effective with multiple cores secured by the same metal sheet due to dimensional tolerances.

There is therefore a need for an improved mounting apparatus for an electromagnetic device that minimizes or eliminates one or more of the shortcomings as set forth above.

SUMMARY OF THE INVENTION

The mounting apparatus for an electromagnetic device according to the present invention is characterized by the features specified in claim 1.

One advantage of the present invention is that it provides improved thermal conduction from the magnetic core to a heat sink to thereby maintain relatively cooler magnetic cores/windings. In addition, the present invention integrates the function of a vibration resistant mounting system with a thermal cooling system.

A mounting apparatus in accordance with the invention is provided for mounting and cooling an electromagnetic device. The electromagnetic device is of the type having a first winding disposed on a core formed of magnetically-permeable material. The mounting apparatus includes a first heat sink and a second heat sink, characterized in that: one of the first and second heat sinks comprises a mounting cup formed of thermally-conductive material having a cavity configured to receive the electromagnetic device, the mounting cup including a flange portion for attachment to the other one of the first and second heat sinks; and potting material disposed in the cavity of the mounting cup encapsulating portions of the electromagnetic device, wherein the flange includes a passage for routing leads of the first winding out of the cavity.

Other objects, features, and advantages of the present invention will become apparent to one skilled in the art from the following detailed description and accompanying drawings illustrating features of this invention by way of example, but not by way of limitation.

DETAILED DESCRIPTION OF THE PREFERRED EMBODIMENTS

Figure 1:
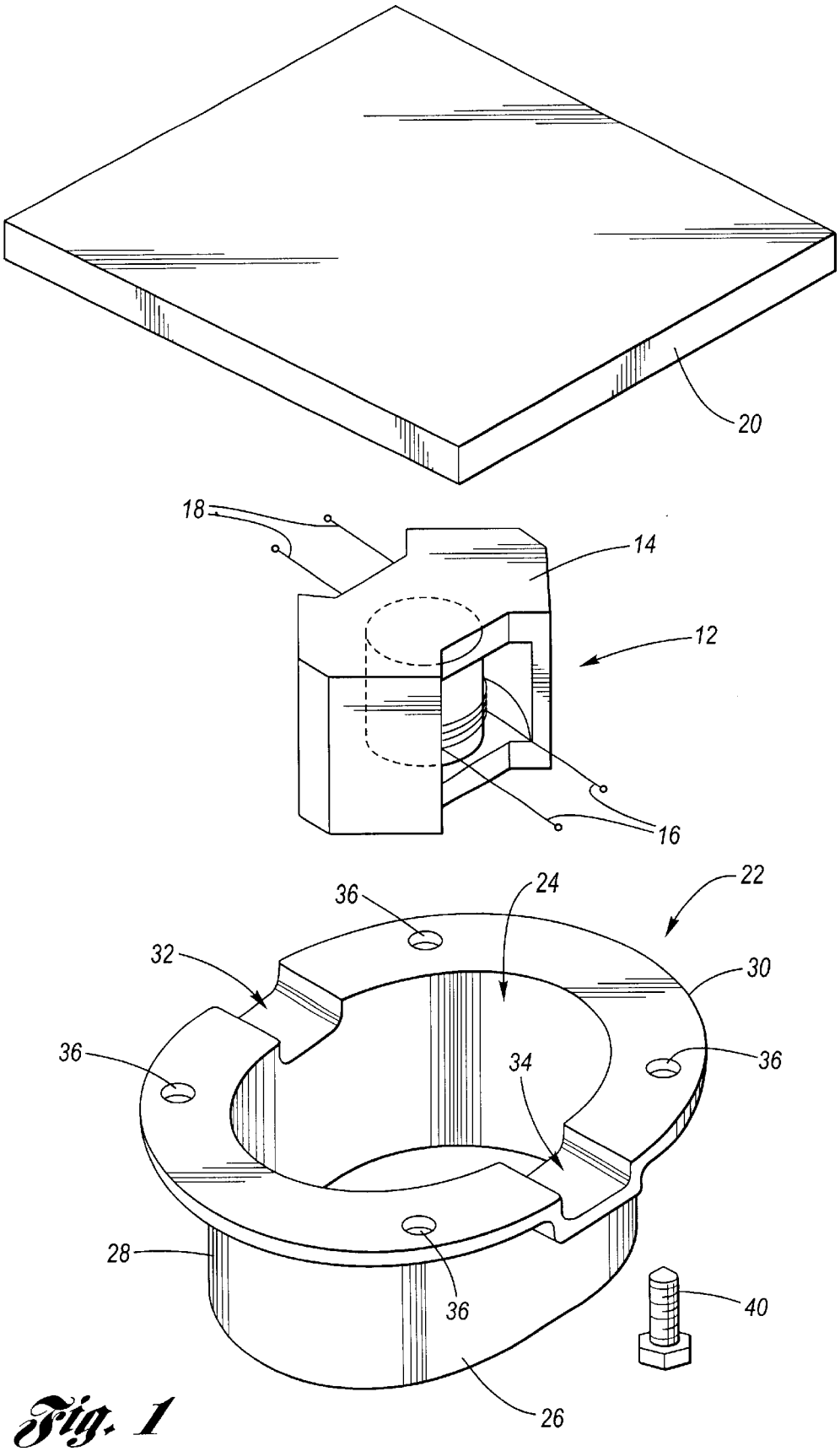
FIG. 1 is a simplified, perspective, exploded view of a mounting apparatus for an electromagnetic device in accordance with the present invention.

Referring now to the drawings wherein like reference numerals are used to identify identical components in the various views, FIG. 1 illustrates a mounting apparatus 10 for mounting an electromagnetic device 12, and which further performs the function of cooling electromagnetic device 12.

Electromagnetic device 12 includes a magnetic core 14, a first winding 16, and an optional second winding 18. Electromagnetic device 12 may be an inductor wherein only first winding 16 is used. It should be appreciated, however, that core 14 may carry both windings 16, and 18, for example, where the electromagnetic device is a transformer. Other winding configurations are consistent with the present invention. Core 14 is preferably formed of a magnetically permeable material and may be formed, for example, from either steel laminations, or, insulated iron particles shaped and formed by way of a compression molding operation as known to those of ordinary skill in the art.

Mounting apparatus 10 includes a first heat sink, such as heat sink plate 20, and a second heat sink, such as mounting cup 22.

First heat sink 20 is formed of thermally-conductive material such as aluminum, or a copper alloy. Heat sink 20 has a main body portion, which may be generally rectangular in shape, in the illustrated embodiment. As referred to above, heat sink 20, as illustrated, may be generally planar, at least on one side and is configured in size to be larger than mounting cup 22 for purposes of attachment thereto. Other devices like power transistors, capacitors, and resistors may also be mounted to heat sink 20 at other locations. Heat sink 20 may have fins on its back side for convection heat transfer or it may simply be connected to a third, remote heat sink where the heat is carried away by convection.

Mounting cup 22 is also formed of a material having a high thermal-conductivity, such as aluminum or a copper alloy. Mounting cup 22 has an axis, designated "A", associated therewith (best shown in FIG. 2), and includes a centrally-disposed cavity 24, a base 26, an annular sidewall 28, a flange 30, a first passage 32, a second passage 34, and a plurality of bore holes 36. Mounting apparatus 10 may further include, in an alternate embodiment, conformal material 38 (best shown in FIG. 2). In either embodiment, mounting cup 22 may be attached to heat sink 20 by conventional fasteners 40.

Cavity 24 is configured in size and shape to receive electromagnetic device 12. Preferably, in one embodiment, the height of cavity 24, as taken along axis A, is slightly greater than the height of electromagnetic device so as to allow for conformal material 38 to be inserted between an upper surface of core 14 and the inner surface of base 26 of the mounting cup 22. Conformal material 38 provides for a dimensional variation of both device 12 and cup 22 while effectively transferring heat there between.

Figure 2:
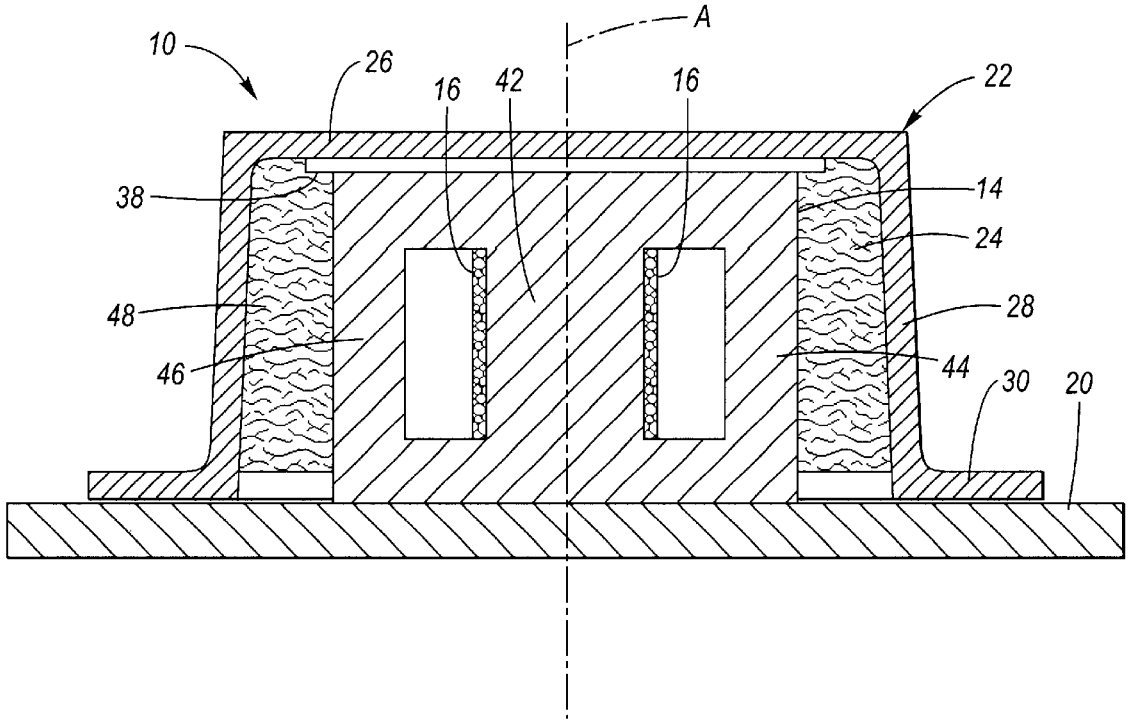
FIG. 2 is a simplified, cross-sectional view of a mounting apparatus as assembled containing the electromagnetic device of FIG. 1.

Base 26 is substantially planar in the illustrated embodiment, and is substantially perpendicular to axis A. The inner surface of base 26 is configured to correspond to the opposing surface of core 14 (top in FIG. 2). As shown in FIG. 2, both surfaces are generally flat, but need not be.

Annular sidewall 28 is generally axially-extending between base 26 and flange 30. In the illustrated embodiment, sidewall 28 has a generally elliptical shape in radial cross-section. Additionally, sidewall 28 exhibits a radially-increasing taper, from base 26 to flange 30. However, it should be understood that the shape of mounting cup 22 may be adapted with respect to size and shape to correspond to a wide variety of shapes and sizes of magnetic core 14.

Mounting cup 22, in a constructed embodiment, may be manufactured by deep drawing the cup shape from sheet blanks. Other manufacturing approaches, however, are possible, consistent with the spirit and scope of the present invention.

Flange 30 is configured to provide a mounting function, whose generally flat outer surface solidly engages an upper surface of heat sink 20. The flat surfaces promote a solid mechanical mounting. Additionally, the contact between flange 30 and heat sink 20 allows for an efficient transfer of heat from mounting cup 22 to heat sink 20. Heat also flows from core 14 directly to heat sink 20.

Passages 32 and 34 are configured to allow routing of the leads of first and second windings 16, 18 out of cavity 24. It should be understood, however, where only one winding, for example, first winding 16, is employed in electromagnetic device 12, that only one passage may be required. Additionally, both passages may be implemented in embodiments where only one winding is used, without any detriment to the operation of mounting apparatus 10. Other routing orientations for windings may result in a greater or fewer number of passages, all consistent with the present invention.

Each bore hole 36 is configured to receive a corresponding fastener 40 for attaching mounting cup 22 to heat sink 20 (as illustrated in exploded form in FIG. 1).

Referring to FIG. 2, core 14 includes, in the illustrated embodiment, a central leg 42, and a pair of opposing outer legs 44, and 46. As described in the Background, it is important to conduct heat away from the windings of electromagnetic device 12, for example, away from first winding 16. In accordance with the invention, mounting apparatus 10 further includes potting material 48 disposed in cavity 24 of mounting cup 22. Material 48 encapsulates, at least in part, portions of electromagnetic device 12. In one embodiment, potting material 48 comprises a polyurethane resin material. Suitable potting materials for use in the present invention are commercially available, such as, for example, a resin sold under the trade name UR-312, by Thermoset, Lord Chemical Products, Indianapolis, Ind., USA. The UR-312 resin is characterized by a shore 00 hardness of 50, a clear color, and which cures to a soft, low modulus gel and remains in that state down to −80° C. Potting material 48, as described above, exhibits excellent thermal-shock properties and a has a 50 PSI tensile strength.

Conformal material 38 is a relatively thermally-conductive material, and which may exhibit some level of plastic deformation properties. In accordance with the invention, suitable conformal materials 38 may be either electrically isolative (i.e., dielectric), or non-electrically isolative. Preferably, the higher conductivity conformal materials that are presently available comprise the non-electrically isolative type. Inasmuch as electrical isolation for magnetic core 14 is not required in the present invention, such conformal materials are preferred. Conformal materials 38 are commercially available, such as, for example, materials sold under the tradename THERM-A-GAP, by Chomerics, a division of Parker Hannifin Corp., Woburn, Mass., USA. The exemplary product described above consists of an extremely soft silicone elastomer loaded with ceramic particles laminated onto either an aluminum foil carrier (e.g., 0.050 millimeters thick) for electrically non-isolative uses, or a thin, thermally conductive fiberglass carrier for electrically isolative uses. The total thickness of conformal material 38, the height of core 14 (taken along axis "A"), and the depth of cavity 24 is coordinated as follows, in one embodiment. The thickness of conformal material 38 is selected to be at least four (4) times the value of maximum tolerance variation between the core 14 and cavity 24. As a result, the core 14, when encapsulated in cup 22 with potting material 48, extends slightly beyond the plane shared by mounting flange 30 by about ¼ the thickness of conformal material 38. This dimensional relationship allows slight compression of material 38 on tightening of fasteners 40, thus ensuring a positive pressure contact with heat sink 20 by taking up dimensional variation in the parts. The foregoing arrangement promotes good heat transfer at the interface between core 14 and heat sink 20. Grease loaded with zinc oxide may be applied to the surface of core 14 to bridge any small air gaps at the core 14/heat sink 20 interface. Heat thus easily transfers through this interface. Preferably, no potting material 48 should be between core 14 and heat sink 20.

In accordance with the invention, mounting apparatus 10 integrates thermal cooling with a shock-resistant mounting structure. Mounting cup 22 allows the use of potting material 48 for better thermal paths for cooling electromagnetic device 12 via the walls e.g., base, sidewall, flange) of cup 22 as well as providing a thermally conductive path for core 14/winding 16, 18 to reach heat sink 20. Heat transfer occurs without exposing high temperature components (e.g., like hot wires) directly to the surrounding air, due to the closed-end configuration of mounting cup 22. Cavity 24 of mounting cup 22 functions as a mounting system as well as a thermal cooling structure. In a preferred embodiment, the flat surface of flange 30 engages the flat surface of heat sink 20 and the flat surface of core 14 engages the flat surface of heat sink 20, to provide a solid mechanical mounting to heat sink 20, as well as providing an efficient mechanism for transferring heat from cup 22 and core 14 to heat sink 20. Mounting apparatus 10 is further capable of supporting electromagnetic device 12 under harsh shock loads. Potting material 48 is pliable, cushioning electromagnetic device 12 from vibration and/or shocks.

In a further embodiment, an outside surface of mounting cup 22 (i.e., the surface not abutting cavity 24) may be coated with a thermal insulator or the like in order to reduce heat rejection to the surrounding air. The insulation minimizes air temperature elevation to thereby reduce the chance of damage to neighboring electrical components.

EXAMPLE

This example describes the thermal transfer improvements of mounting apparatus 10 relative to a conventional heat sink arrangement.

Conventional Arrangement

Electromagnetic device 12 is disposed between two generally planar metallic heat sinks. Five amperes of primary current is established through first winding 16, and 30 amperes of current is established through secondary winding 18, for a total heat input of 7.6 watts. The temperature rise observed between the windings and the heat sink was observed to be: DT=40.8° C. or 5.4° C./W.

Electromagnetic device 12 is mounted using mounting apparatus 10 in accordance with the invention: the same inputs as described above were used, the observed temperature rise was: DT=22.5° C., or 3.0° C./W.

It is to be understood that the above description is merely exemplary rather than limiting in nature, the invention being limited only by the appended claims. Various modifications and changes may be made thereto by one of ordinary skill in the art which embody the principals of the invention and fall within the spirit and scope thereof.

What is claimed is:

1. A mounting apparatus for an electromagnetic device having a first winding disposed on a core formed of magnetically-permeable material, said mounting apparatus including a first heat sink and a second heat sink, characterized in that:

one of the first and second heat sinks comprises a mounting cup formed of thermally-conductive material having a cavity configured to receive the electromagnetic device, the mounting cup including a flange for attachment to the other one of the first and second heat sinks;

potting material disposed in the cavity of the mounting cup encapsulating at least in part portions of the electromagnetic device; and wherein the flange includes a first passage for routing leads of the first winding out of the cavity.

2. The mounting apparatus of claim 1 wherein the mounting cup has an axis associated therewith, and includes a base perpendicular to the axis, and an axially-extending annular sidewall between the base and the flange.

3. The mounting apparatus of claim 2 wherein the sidewall is elliptical in radial cross-section.

4. The mounting apparatus of claim 2 wherein the mounting cup comprises at least one of aluminum and copper material.

5. The mounting apparatus of claim 2 wherein the electromagnetic device includes a second winding disposed on the core, the flange further including a second passage for routing leads of the second winding out of the cavity.

6. The mounting apparatus of claim 1 wherein the potting material comprises a polyurethane resin material.

7. The mounting apparatus of claim 6 wherein the polyurethane resin material has a shore 00 hardness of about 50.

8. The mounting apparatus of claim 1 further including a conformal material disposed between an inner surface of the base and the electromagnetic device.

9. The mounting apparatus of claim 8 wherein the conformal material comprises ceramic particles dispersed in a silicone elastomer laminated onto one of an aluminum carrier film and a fiberglass carrier film.

10. The mounting apparatus of claim 1 wherein the flange extends radially outwardly of the core, said cup surrounding the electromagnetic device to thereby conduct heat originating from all sides of the core.

11. An electromagnetic apparatus comprising:

a core formed of magnetically-permeable material;

a first winding disposed on said core;

a first heat sink formed of thermally-conductive material;

a mounting cup formed of thermally-conductive material having a cavity, said core being disposed in said cavity, said cup surrounding said core, said mounting cup including a flange, said mounting cup being attached to said first heat sink wherein said flange abuts a surface of said first heat sink;

potting material disposed in said cavity encapsulating at least in part portions of said core; and wherein said mounting cup includes a first passage for routing leads of said first winding out of said cavity.

12. The electromagnetic apparatus of claim 11 wherein said mounting cup has an axis associated therewith, and includes a base perpendicular to said axis, and an axially-extending annular sidewall between said base and said flange.

13. The electromagnetic apparatus of claim 12 wherein said sidewall is elliptical in radial cross-section.

14. The electromagnetic apparatus of claim 12 wherein said mounting cup comprises at least one of aluminum and copper material, said apparatus further including a second winding disposed on said core, said mounting cup further including a second passage for routing leads of said winding out of said cavity.

15. The electromagnetic apparatus of claim 14 wherein said potting material comprises a polyurethane resin material, said apparatus further including a conformal material disposed between an inner surface of said base and said core, said conformal material comprising a thermally-conductive material having plastic deformation properties.

16. The mounting apparatus of claim 8 wherein a combined thickness of said conformal material in an uncompressed condition and a thickness of said electromagnetic device is greater than a height of said cup taken between said inner surface of said base and a plane containing the bottom of said flange.

* * * * *